United States Patent [19]

Bowden, Jr.

[11] 4,379,607

[45] Apr. 12, 1983

[54] SHUTTERED RECEPTACLE

[75] Inventor: Wade R. Bowden, Jr., Northport, N.Y.

[73] Assignee: Slater Electric Inc., Glen Cove, N.Y.

[21] Appl. No.: 194,615

[22] Filed: Oct. 6, 1980

[51] Int. Cl.[3] ..... H01R 13/44

[52] U.S. Cl. ..... 339/40

[58] Field of Search ..... 339/40, 41, 42

[56] References Cited

U.S. PATENT DOCUMENTS

| | | | |
|---|---|---|---|
| 2,155,925 | 4/1939 | Blinn . | |
| 2,528,014 | 10/1950 | Moses, Jr. et al. . | |
| 2,545,536 | 3/1951 | Von Holtz . | |
| 2,553,837 | 5/1951 | Von Holtz . | |
| 2,701,347 | 2/1955 | Davidsson . | |
| 2,820,842 | 1/1958 | Meistrell . | |
| 3,736,547 | 5/1973 | Koenig . | |
| 4,072,382 | 2/1978 | Reschke . | |
| 4,271,337 | 6/1981 | Barkas | 339/40 X |

FOREIGN PATENT DOCUMENTS

| | | |
|---|---|---|
| 508248 | 6/1939 | United Kingdom . |

*Primary Examiner*—Joseph H. McGlynn

*Attorney, Agent, or Firm*—Morgan, Finnegan, Pine, Foley & Lee

[57] ABSTRACT

An electrical receptacle has shuttered slots for preventing the entry of foreign objects into the slots other than the prongs of an electrical plug. A housing within the cover of the receptacle is located behind the receptacle slots. A shutter is located within the housing and is formed of two identical sliding members guided by a stationary member. Each of the sliding members is formed of a blade and a cam which are spaced apart by a distance corresponding to the spacing of a pair of slots, and are mounted transversely to a connecting spine. The blade and the cam of each of the sliding members are offset in both transverse and longitudinal directions from each other about the spine in order to permit an interleaving of the blade of one sliding member with the cam of the other sliding member. The sliding members are positioned with their spines in opposed positions and in contact with opposite sides of the stationary member.

23 Claims, 35 Drawing Figures

SHUTTERED RECEPTACLE

BACKGROUND OF THE INVENTION

This invention relates generally to electrical receptacles and, more particularly, to certain new and useful improvements in a safety shutter mechanism for use in such receptacles to prevent the entry of small objects such as screwdrivers and paper clips which may be manipulated by an inquisitive child into the slots of such receptacles.

Electrical receptacles are utilized in large numbers both in industry and in the home to provide ready access for electricity to power a variety of devices including motors, lamps, heating elements and amusement articles. These devices are connected to a source of electric power by means of an electric power cord having a plug at an end thereof, the prongs of the plug being inserted into matching slots of the receptacle.

A problem arises in that the slot of the receptacle will admit other objects in addition to the aforementioned prongs. For example, the blade of a screwdriver or of a jackknife, a paper clip, and a metal tang or protrusion of a child's toy may all fit within the receptacle slot. Such metallic electrically-conducting objects present the hazard of electric shock to an inquisitive child who may deliberately or inadvertently insert such an object into the slot.

The desirability of a safety mechanism for preventing electrical shock upon entry of such objects into electrical receptacles has been previously recognized. The numerous prior proposals for such mechanisms, however, have not performed satisfactorily, or have been complicated or difficult to assemble, or expensive to manufacture and, accordingly, either have not reached or have not been accepted by, the general public. Thus, in spite of the numerous prior attempts to provide a commercially acceptable safety receptacle, and the long-sought need for such a device, it is believed that no such device has achieved commercial success.

In one such prior proposal, insertion of a prong or blade through one receptacle slot actuates a switch bringing electricity to the opposite terminal, thus requiring simultaneous insertion of blades into both slots in order to accomplish electrical contact. This device is disadvantages because proper assembly is critical and difficult and the additional switches result in added heat rise in operation. In another prior proposal, a shutter in the form of a disc includes a cam surface operated only by the ground pin of an appliance plug, the ground pin rotating the disc to open the receptacle slots. This device is disadvantageous because it requires the use of an appliance plug with a grounding pin for operation.

Other prior proposals for shutter mechanisms in electrical receptacles are shown in U.S. Pat. No. 2,548,536 (1951) and British Pat. No. 508,248 (1939). While the operation of the devices shown in these patents is similar to that of the present invention, the structure of U.S. Pat. No. 2,548,536 (1951) is disadvantageous from the standpoint of reliability in that it requires the parts to rock into alignment in order to open the receptacle slots, which may be difficult. British Pat. No. 508,248 (1939) is disadvantageous because its structure is designed for use only with a plug having two blades and would not be capable of use with a plug also containing a grounding prong, which is conventional in the United States.

It is therefore an object of this invention to provide a novel electrical receptacle wherein the receptacle slots are shuttered so as to prevent inadvertent electrically-conducting contact with the receptacle terminals.

Another object of this invention is to provide in a novel electrical receptacle a safety shutter mechanism providing a barrier to entry through the receptacle slots except upon the simultaneous insertion of a blade or prong into each of the slots.

Another object of this invention is to provide in a novel electrical receptacle a safety shutter mechanism in which two identical oppositely disposed slides, each including a barrier surface and a cam surface, are arranged so that both a barrier surface and a cam surface are in register with each of the receptacle slots.

Another object of this invention is to provide a novel electrical receptacle having a safety mechanism for the receptacle slots which eliminates the aforementioned disadvantages of the prior proposals for such a safety mechanism.

Another object of this invention is to provide in a novel electrical receptacle a safety shutter mechanism which is simple in its construction, easily assembled, reliable and trouble-free in operation and may be manufactured at low cost.

Objects and advantages of the invention are set forth in part herein and in part will be obvious herefrom, or may be learned by practice with the invention, the same being realized and attained by means of the instrumentalities and combinations pointed out in the appended claims.

The invention consists in the novel parts, constructions, arrangements, combinations and improvements herein shown and described.

SUMMARY OF THE INVENTION

Briefly described, the present invention is directed to a new and improved safety shutter mechanism for an electrical receptacle to prevent unwanted or inadvertent insertion of any object other than an electrical plug into the receptacle slots.

In accordance with the invention, the shutter is placed within the path to be traversed by the prongs of a plug which are inserted through slots on the face of the receptacle to engage terminals within a base portion of the receptacle. The shutter comprises a pair of identical hermaphroditic sliding members, or slides, and a fixed frame which guides the slides within the receptacle. In addition, supporting and guiding structures for the shutter are provided along the interior walls of the receptacle behind the face of the receptacle.

In accordance with a preferred embodiment of the invention, each slide is in the form of a spine having two leg portions extending transversely therefrom at opposite ends thereof. The leg portions are spaced relative to each other so as to permit a single plane parallel to the longitudinal axis of the spine to pass above one of the leg portions and beneath the other of the leg portions. One leg portion is formed with a cam surface and serves as a cam which is deflected by a prong of a plug inserted into a slot of the receptacle. The other leg portion is formed as a blade which prevents the entry of any foreign object from passing through a slot and into a terminal of the receptacle. Upon mounting of the slide within the receptacle, the cam is positioned behind one slot of a pair of slots while the blade is positioned behind the second slot of the pair of slots.

The blade is positioned below the aforementioned longitudinal plane, away from the receptacle face, and the cam is positioned above the aforementioned longitudinal plane, at the backside of the receptacle face. The two slides are located within the receptacle by positioning them in opposed directions such that the blade of one slide sits behind the cam of the other slide. This is in accordance with the hermaphroditic relation of each of the slides.

In operation, it will be seen that entry of one prong into the first slot deflects the first cam, removing the first blade from behind the second slot. Similarly, entry of a second prong into the second slot deflects the second cam for removal of the second blade from behind the first slot. Thus, entry of an object into any one slot removes the blade from behind the opposite slot. Since the blade serves as a barrier to the entry of an object into the terminal of the receptacle, passage through any slot is afforded only upon the condition that two prongs are simultaneously applied through both slots against each of the cams for the simultaneous removal of the two blades from behind their respective slots.

The restoration of the blades to their original positions behind their respective slots, upon removal of the plug, is accomplished by resilient members or springs. In one embodiment of the invention, cam surfaces are located along external aspects of the slides, and a spring is located between the cams to urge them outwardly against the inward thrust of the prongs of a plug. In a second embodiment of the invention, cam surfaces are located along internal aspects of the slides, and integrally molded resilient members extend outwardly from the slides to contact the walls of the receptacle. The resilient members urge the cams inwardly against the outward thrust of the prongs of the plug.

The arrangement of the spring between the cams in the first embodiment is advantageous during construction of the shuttered receptacle. Notches within the spines of the slides engage portions of opposed slides to act as stops to spring induced movement and, thereby, enable the spring to maintain the shutter elements in their respective positions during manipulation of the shutter at assembly. In the second embodiment of the invention, the integral formation of the resilient members with the slides reduces the number of shutter elements, thereby, facilitating assembly and reducing the shuttered receptacle cost.

It will be apparent from the foregoing general description that the objects of the invention specifically enumerated herein are accomplished by the invention as here embodied. Thus, the configuration of the slides and of the frame permits the shutter to be mounted in a relatively small space within the receptacle, and also permits the fabrication of the slides and frame by conventional molding procedures which facilitates manufacture at low cost and insures reliable operation.

It will be understood that the foregoing general description and the following detailed description as well are exemplary and explanatory of the invention but are not restrictive thereof.

The accompanying drawings, referred to herein and constituting a part hereof, illustrate the preferred embodiments of the invention, and together with the description, serve to explain the principals of the invention.

Figure 5:
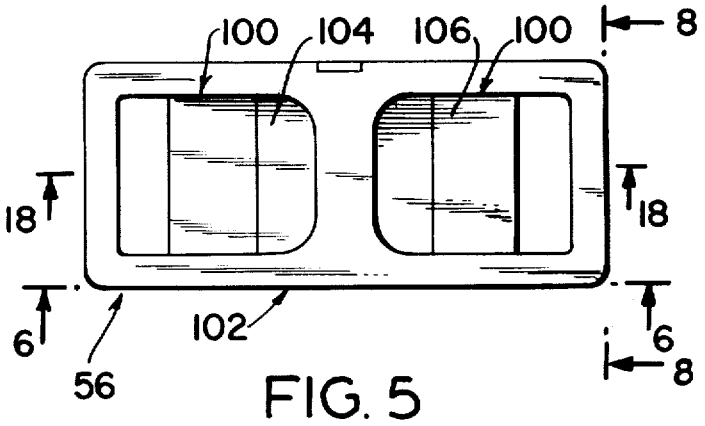
FIG. 5 is an enlarged bottom plan view of the shutter of FIG. 3, showing the frame for the shutter slides.
Figure 6:
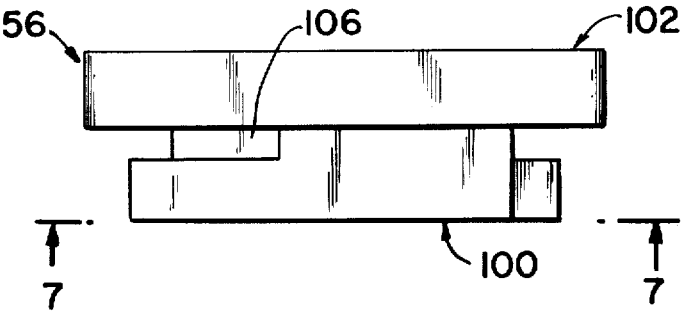
FIG. 6 is a side elevation view of the shutter of FIG. 3 taken along the line 6—6 of FIG. 5.
Figure 7:
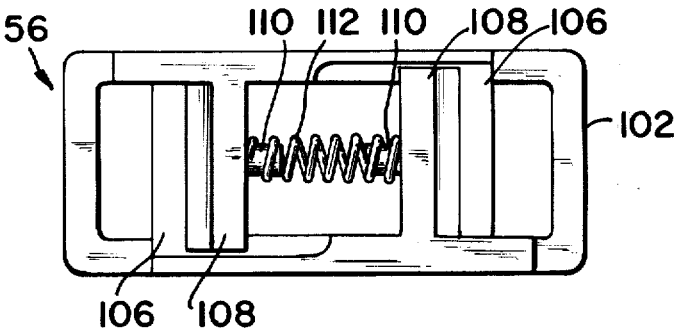
FIG. 7 is an enlarged top plan view of the shutter of FIG. 3 taken along the line 7—7 in FIG. 6, showing the shutter slides mounted on the shutter guide frame.
Figure 8:
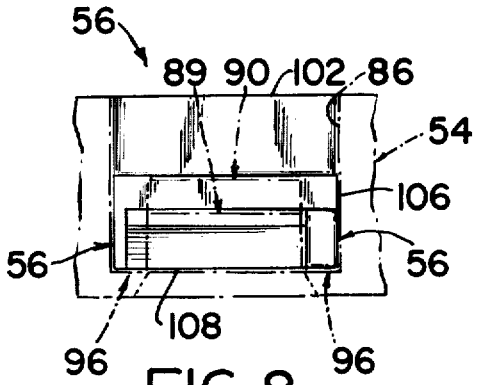
FIG. 8 is an elevation view of an end of the shutter taken along the line 8—8 in FIG. 5, the view also showing in phantom a portion of the receptacle which houses the shutter.
Figure 9:
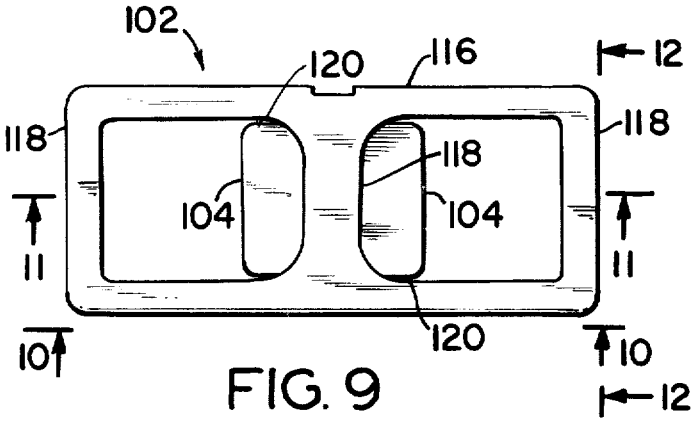
FIG. 9 is a plan view of a frame of the shutter of FIG. 3, the frame including a baffle to assure no electrical arcing from the receptacle terminals to the spring and which also serves as a guide for the slides.
Figure 10:
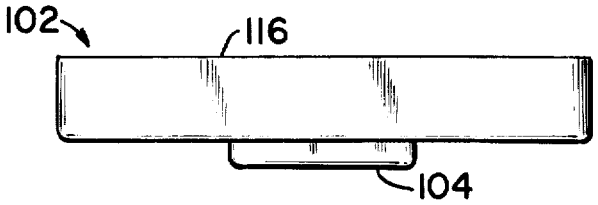
FIG. 10 is a side elevation view of the frame taken along the line 10—10 in FIG. 9.
Figure 11:
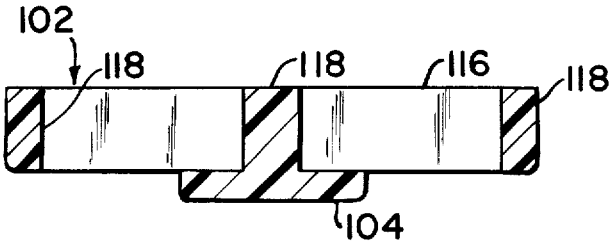
FIG. 11 is a sectional view of the frame taken along the line 11—11 in FIG. 9.
Figure 12:
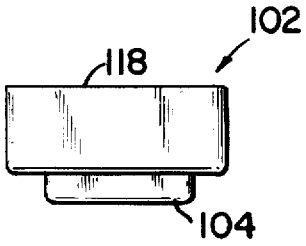
FIG. 12 is an elevation view of an end of the frame taken along the line 12—12 in FIG. 9.
Figure 13:
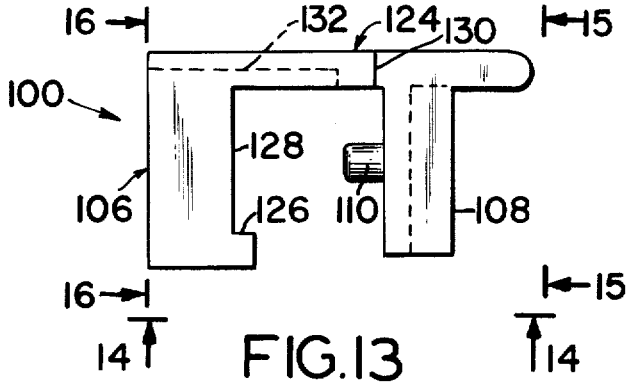
FIG. 13 is a plan view of a slide of the shutter of FIG. 3.
Figure 16:
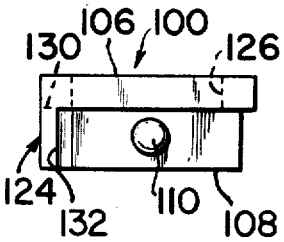
FIG. 16 is an elevation view of the opposite end of the slide taken along the line 16—16 in FIG. 13.
Figure 14:
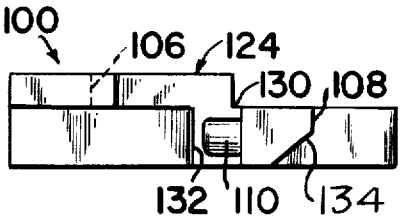
FIG. 14 is a side elevation of the slide taken along the line 14—14 in FIG. 13.
Figure 15:
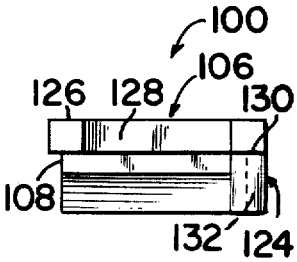
FIG. 15 is an elevation view of an end of the slide taken along the line 15—15 in FIG. 13.
Figure 17:
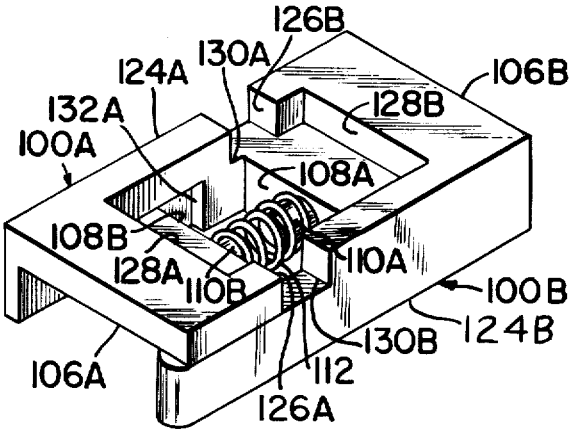
FIG. 17 is an isometric view of a portion of the shutter of FIG. 3, namely, the two identical slides positioned in interlocking relationship with a spring therebetween, the view being taken from the bottom of the slide members showing the portions thereof which are fitted about the frame guide member.
Figure 19:
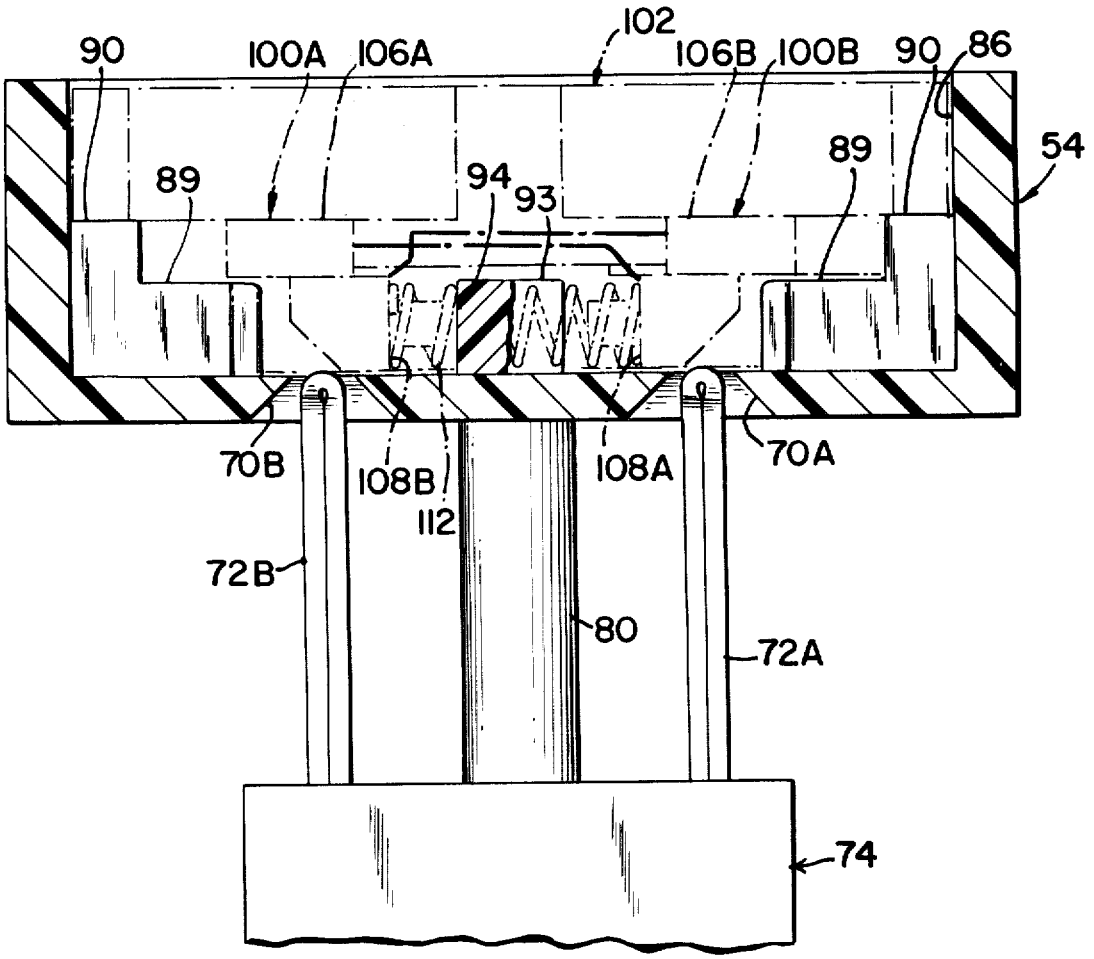
FIG. 19 is a stylized sectional view of an end of the cover of the receptacle, taken along the line 19—19 in FIG. 4, the view showing the shutter mechanism of the invention in phantom, and in operation with the prongs of an electrical plug entering slots of the receptacle cover.
Figure 20:
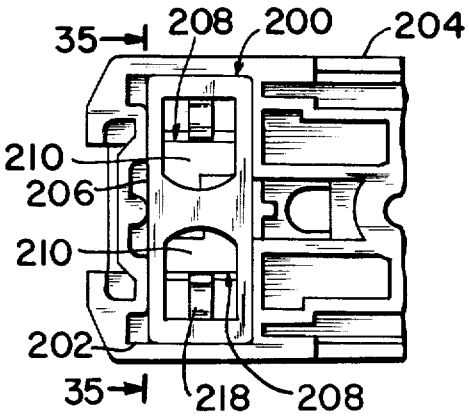
FIG. 20 is a plan view of a portion of the cover in an alternative embodiment of the receptacle, the view being taken in the same direction as the corresponding view in FIG. 3 and showing a shutter mechanism constructed in accordance with an alternative embodiment of the invention.
Figure 21:
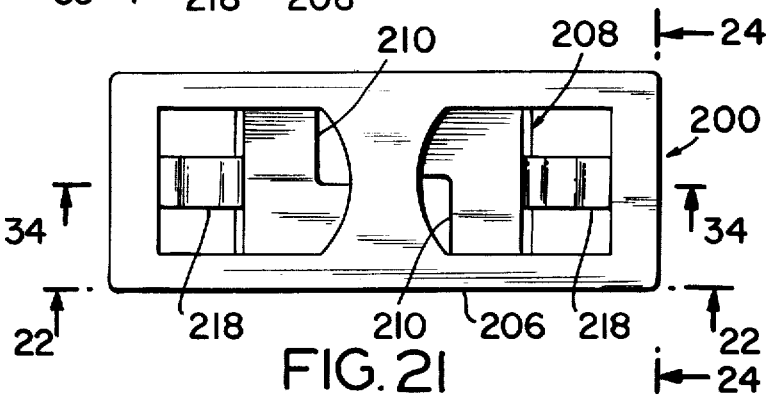
FIGS. 21, 22 and 23 show, respectively, a bottom plan view, a side elevation view and a top plan view of the shutter secured within the receptacle cover of FIG.
Figure 22:
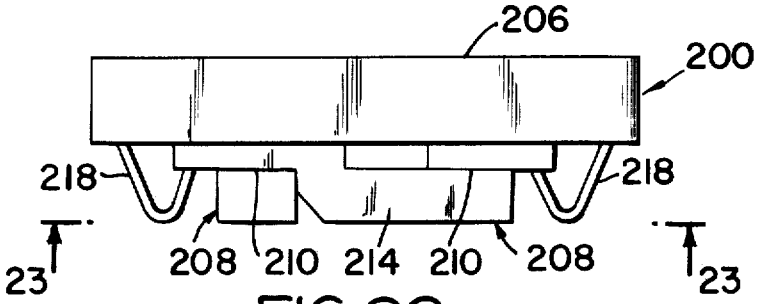
Figure 23:
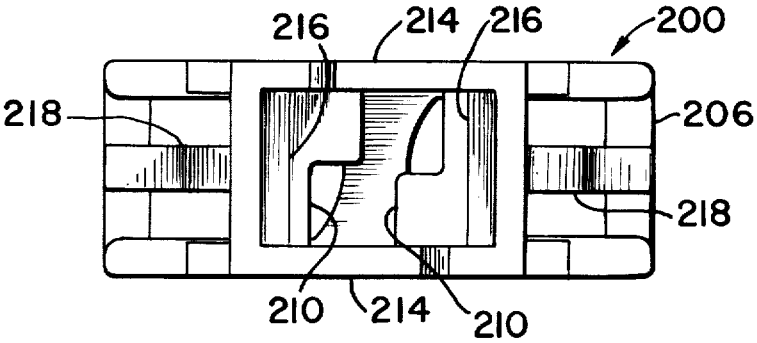
Figure 24:
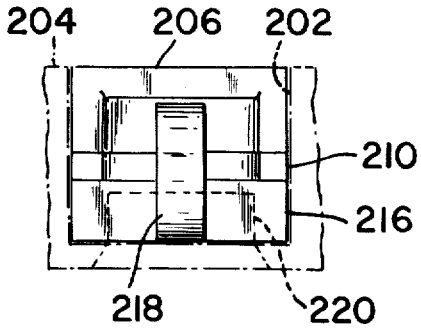
Figure 25:
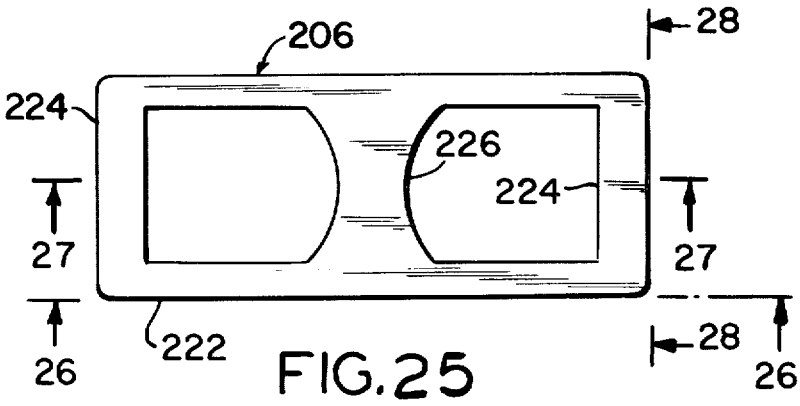
Figure 26:
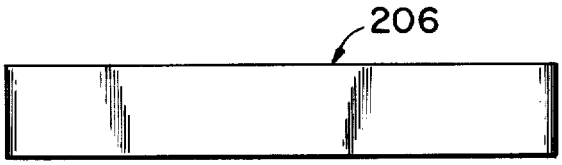
Figure 27:
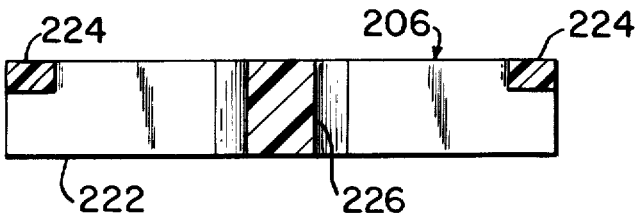
Figure 28:
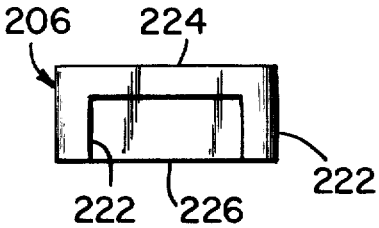
Figure 29:
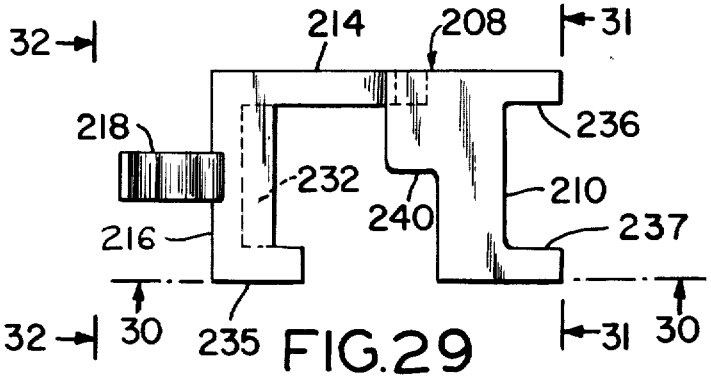
Figure 32:
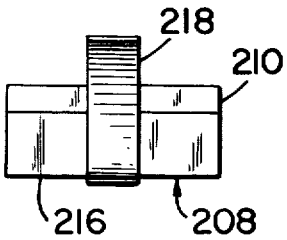
Figure 30:
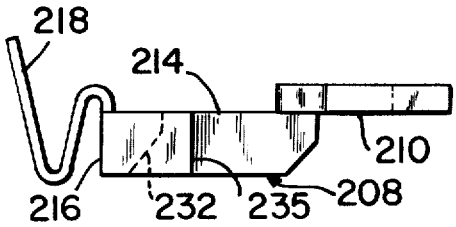
Figure 31:
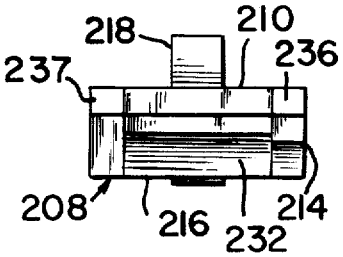
Figure 33:
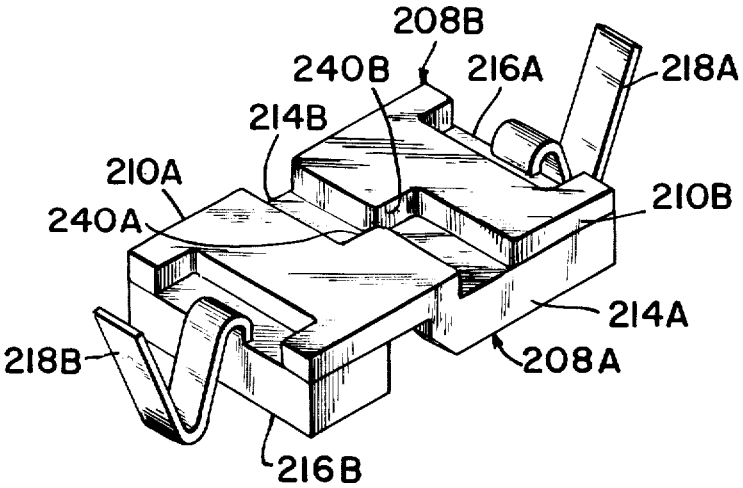
Figure 34:
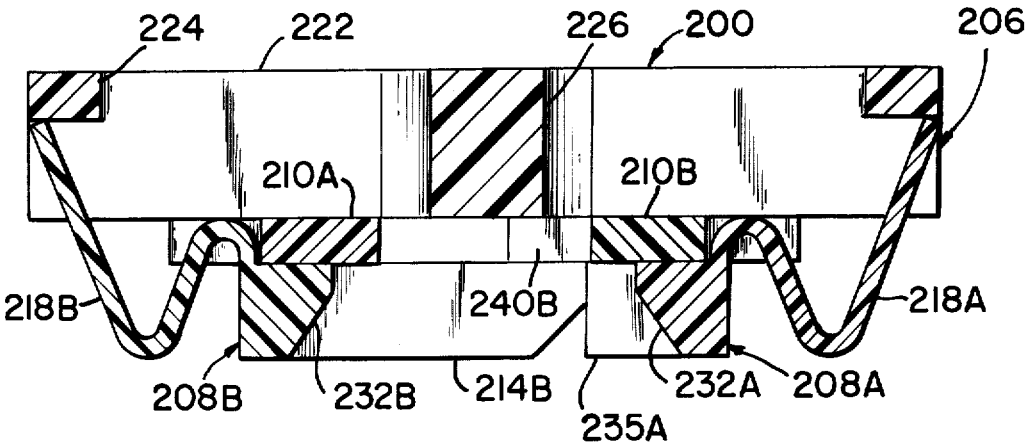
Figure 35:
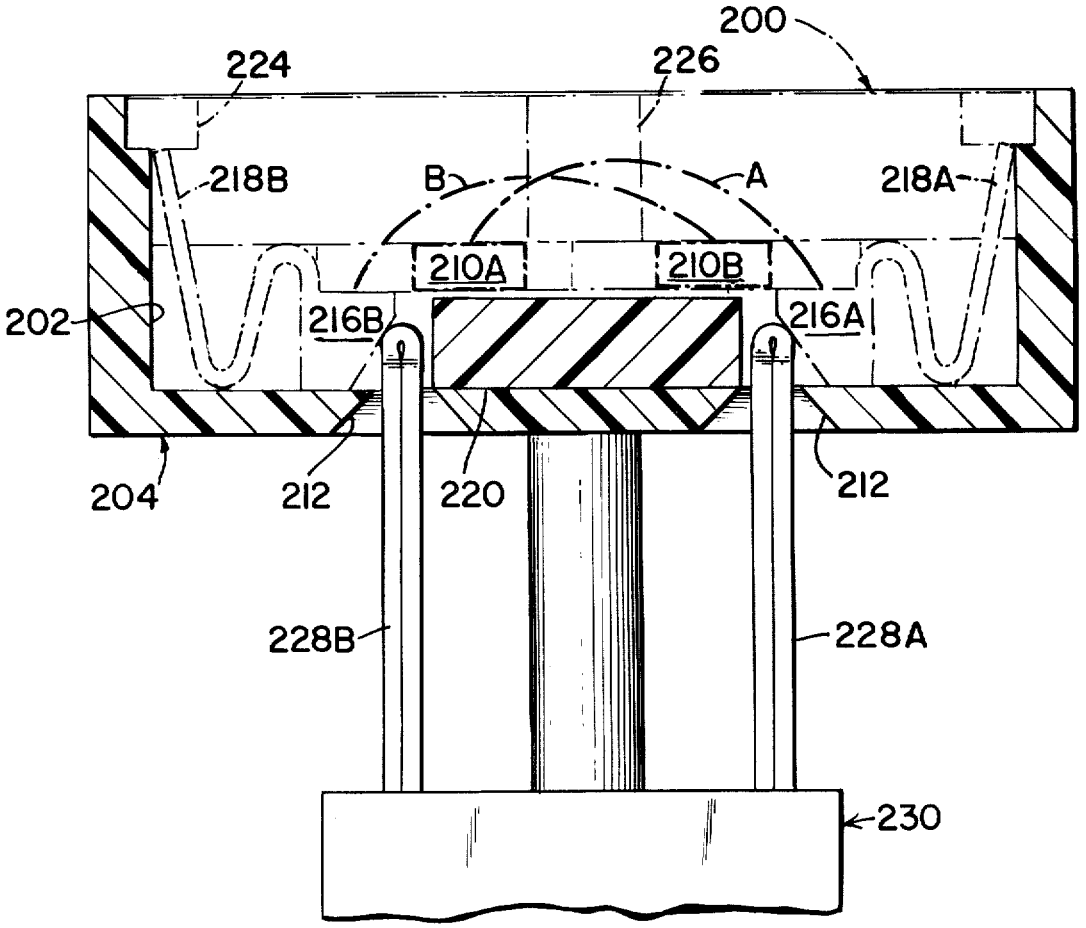

20 with the views being taken in the same directions as the corresponding views of FIGS. 5, 6 and 7, respectively;

FIG. 24 is an elevation view of an end of the shutter taken along the line 24—24 in FIG. 21, the view also showing in phantom a portion of the receptacle cover which houses the shutter, the view being taken in the same direction as the corresponding view of FIG. 8;

FIGS. 25, 26, 27 and 28, respectively, show a plan view, a side elevation view, a sectional view and an end elevation view of the frame of the shutter of FIG. 20, the views being taken in the same directions as the corresponding views in FIGS. 9–12;

FIGS. 29, 30, 31 and 32, respectively, show a plan view, a side elevation view, a first end elevation view and a second end elevation view of a slide of the shutter of FIG. 20, the views being taken in the same directions as the corresponding views in FIGS. 13–16, respectively;

FIG. 33 is an isometric view of a portion of the shutter of FIG. 20, namely, the two identical slides positioned in interlocking relationship, the view being taken in the same direction as the corresponding view of FIG. 17;

FIG. 34 is a sectional view of the shutter of FIG. 20 taken along the lines 34—34 in FIG. 21; and FIG. 35 is a stylized sectional view of an end of the receptacle, taken along the lines 35—35 in FIG. 20, the view showing the shutter mechanism of the alternative embodiment of the invention in phantom and in operation with the prong of an electrical plug, the view being taken in the same direction as the corresponding view of FIG. 19.

DESCRIPTION OF THE PREFERRED EMBODIMENT

Referring now to FIGS. 1–4, there is shown an electrical receptacle 50 comprising a base 52 of conventional design, and a cover 54 which houses a safety shutter mechanism embodying the invention, indicated generally by reference numeral 56.

Receptacle cover 54 is secured to the base 52 by a screw 58 passing from the base 52 into a blind threaded aperture 60 in the back of the cover 54. The base 52 includes tabs 62 extending outwardly therefrom for mounting the receptacle 50 to a wall (not shown) or other suitable mounting structure. Screws 64 are provided on the base 52 for the attachment of the lugs of electric wires (not shown), the screws 64 being coupled via metallic straps 66 to terminals 68 which are located in registration with slots 70 in the cover 54. The terminals 68 grasp the prongs of a plug, such as the prongs 72 of a plug 74 seen in FIG. 19, which are to be inserted through the slots 70. The base 52 includes partitions 76 preferably of a rigid electrical insulating material which is readily molded, such as phenolic, polycarbonate, polyester or ABS plastic, for supporting the terminals 68 in their respective positions. Also included are apertures 78 in the cover 54 for receiving a ground prong 80 (FIG. 19), and terminals 82 in the base 52 which mate with the prongs 80 and are coupled to the tabs 62.

Advantageously, and as preferably embodied, cover 54 is also formed of a rigid electrical insulating material such as that of the partitions 76. Receptacle cover 54 also includes partitions 84 which are integrally molded therewith for strengthening the cover 54 and for providing a housing 86 for each of the shutters 56. Each housing includes ribs 89–90 and posts 93–94 to facilitate the positioning of shutter 56, the ribs 89–90 being spaced apart from the sides of the housing 86 by channels 96 to provide space for certain members of the shutter 56, more fully described hereinafter. Both of the ribs 89–90 have elongated portions, the ribs 90 further comprising projections, for mating with the configuration of the shutter 56.

In accordance with the invention, and as here preferably embodied, each shutter mechanism 45 includes a pair of identical slides 100 which slide along a frame 102 in the passageway between the slots 70 and the terminals 68 to alternately open and block the passageway to a prong 72 or similarly shaped object which a child may manipulate during play. A single prong, such as the prong 72 cannot penetrate the barrier presented by the shutter 56 since, as will be seen hereinafter, the presence of such a prong at one of the slots 70 activates the shutter 56 to open the passage only to the adjacent slot 70 without allowing penetration of the prong. Only when two prongs are simultaneously present, this indicating the presence of a plug such as the plug 74, does the passage open to both of the slots 70.

Referring now to FIGS. 5–8, the pair of slides 100 and the frame 102 of a shutter 56 are more readily seen. The frame 102 includes a baffle 104 located between blades 106 of the respective slides 100, the baffle 104 and the blades 106 being shaped in the form of generally rectangular plates. Each of the slides 100 further includes a cam 108 having a pin 110 thereon, as seen in FIG. 7, the cams 108 of the two slides 100 being urged apart by a spring 112 which is supported by the pins 110. The baffle 104 prevents electrical arcing between terminals of the receptacle 50 and the spring 112, the baffle 104 also serving to guide the slides 100 during their respective movements. As seen in FIG. 8, portions of the slides 100 fit within the channels 96 alongside the ribs 89–90 which are portrayed in phantom view, the channels 96 having been previously seen in FIG. 4.

Referring now to FIGS. 9–12, the frame 102 is seen to comprise side arms 116 which are joined by struts 118, the central one of the struts 118 supporting the baffle 104. The baffle 104 is spaced apart from the side arms 116 by a gap 120 and is positioned beneath the lower edges of the side arms 116 so as to engage the blades 106 of the slides 100, previously seen in the FIGS. 3 and 5–8.

Referring now to FIGS. 13–16, the blade 106 and the cam 108 of a slide 100 are seen to be supported by a spine 124 from which they extend perpendicularly in separate but parallel planes. Both the slide 100 of FIGS. 13–16 and the frame 102 of FIGS. 9–12 have shapes which permit their fabrication by the molding of plastic materials such as those disclosed previously with reference to the fabrication of the cover 54. The blade 106 is provided at its outer edge with a tooth 126, the tooth 126 being spaced apart from the spine 124 by a sufficient distance to permit a nesting of an end of the baffle 104 of the frame 102 against the inner edge 128 of the blade 106. In the assembly of the shutter 56 of FIGS. 5–8, the respective spines 124 of the two slides 100 are located on opposite sides of the shutter 56 over the corresponding side arms 116 of the frame 102. To provide space on the spine 124 on one of the slides 100 for the overlying thereon of the blade 106 of the other slide 100, the spine 124 is provided with a notch 130. Similarly, to provide space for the end of the cam 108, of one of the slides 100 upon the spine 124 of the other slide 100, the spine 124 of each slide 100 is provided with a recess 132. Thereby, each slide 100 is provided with the identical form, a hermaphrodite form, permitting the slides 100 to interlock with each other.

Figure 18:
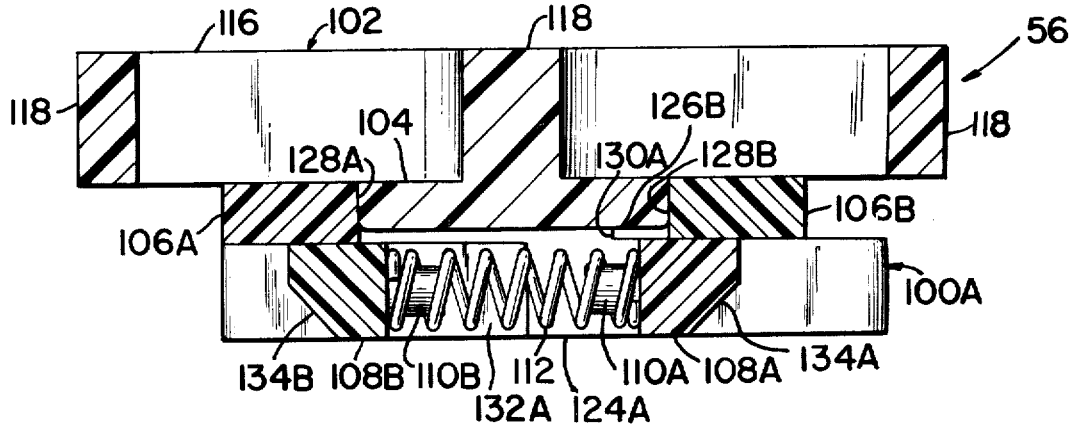
FIG. 18 is a sectional view of the shutter taken along the line 18—18 in FIG. 5.

Referring now to FIGS. 17, 18 and 19, the operation of the shutter 56 may be more readily seen. In FIG. 17, two of the slides 100 have been fitted together in accordance with their respective positions in the assembly of the shutter 56. In FIG. 18, the frame 102 has been located with respect to the two slides 100 to complete the assembly of the shutter 56. To facilitate an explanation of the operation of the shutter 56, the slides 100 have been further identified by the legends A and B such that the spine 124A of the slide 100A is located towards the center of the cover 54 while the spine 124B of the slide 100B is located away from the center of the cap 54. The other elements of each of the slides 100A–B are similarly identified by the legends A and B so that, in viewing the FIGS. 17–19 it is readily apparent which slide element is associated with which of the slides 100A–B.

The hermaphrodite construction of the slides 100 provides for a locating of their respective elements within recesses and notches so that the slides 100 can lay flat within the housing 86 of the cover 54. These construction features are readily apparent in FIG. 17 wherein an end of the blade 106A rests within the notch 130B. The end of the cam 108B slides within the recess 132A. As reviewed in FIG. 17, the cam 108B is located beneath the plane of the lower surface of the blade 106A. Similarly, the cam 108A is located beneath the blade 106B. In each slide 100, both the notch 130 and the recess 132 are sufficiently long to permit the sliding of the slide 100A relative to the slide 100B in a direction transverse to the longitudinal axis of the cover 54.

As seen in FIG. 18, the baffle 104 fits in the space between the blades 106A–B. When the inner edges 128A–B of the blades 106A–B contact the ends of the baffle 104, a clearance space remains between the end of a tooth 126 and its corresponding notch 130 to permit the contacting of the inner edges 128A–B with the baffle 104 upon a closing together of the blades 106A–B. Due to the opposed positions of the blade 106 and the cam 108 of a slide 100, and upon an urging apart of the cams 108A–B by the spring 112, the blades 106A–B are drawn together by the respective spines 124A–B which connect the blades 106A–B with the respective cams 108A–B. Thereby, the spring 112 maintains the two slides 100A–B in contact with the baffle 104 of the frame 102 with the result that the frame 102 with the pair of slides 100 are readily manipulated by a person assembling the receptacle 50 of FIGS. 1–4, the spring pressure permitting the manual emplacement of the shutter 56 within the cover 56. Also, the spring 112, by maintaining the elements of the shutter 56 in contact with each other, facilitates the automatic assembly of the cover 54 with the shutters 56 being emplaced by machinery (not shown) with the cover 54.

Figure 1:
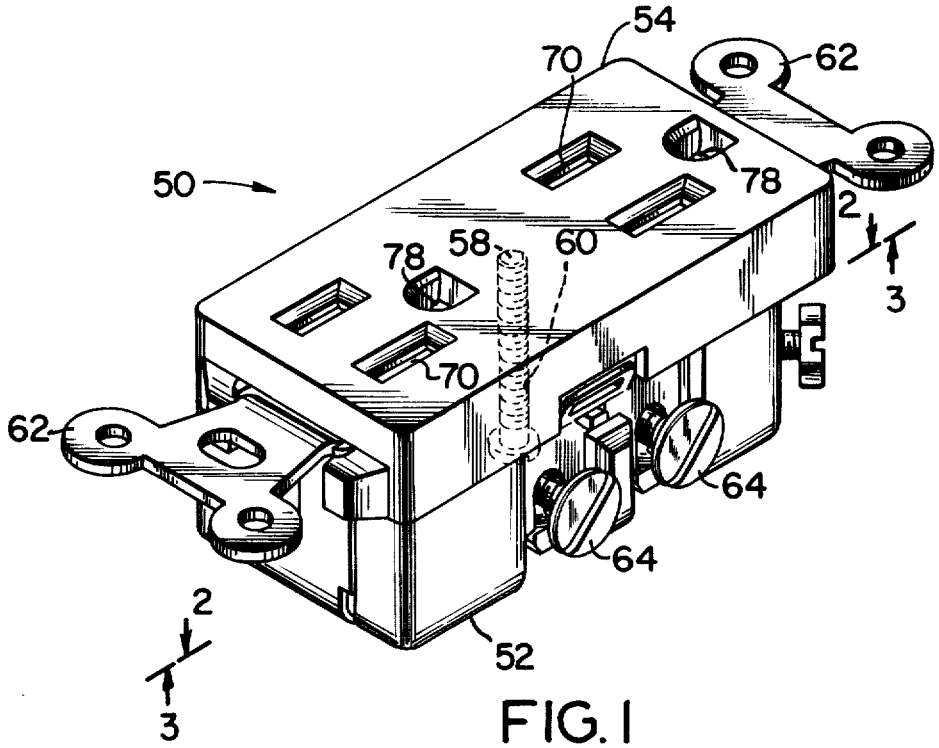
FIG. 1 is a stylized isometric view of a receptacle incorporating the safety shutter mechanism of the present invention.
Figure 2:
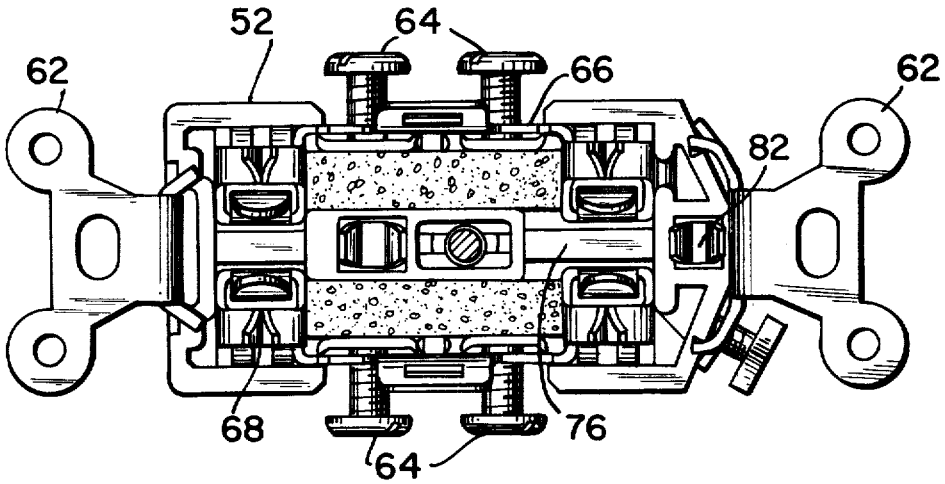
FIG. 2 is a plan view of the base portions of the receptacle taken along the line 2—2 in FIG. 1, the base portion being of conventional design.
Figure 3:
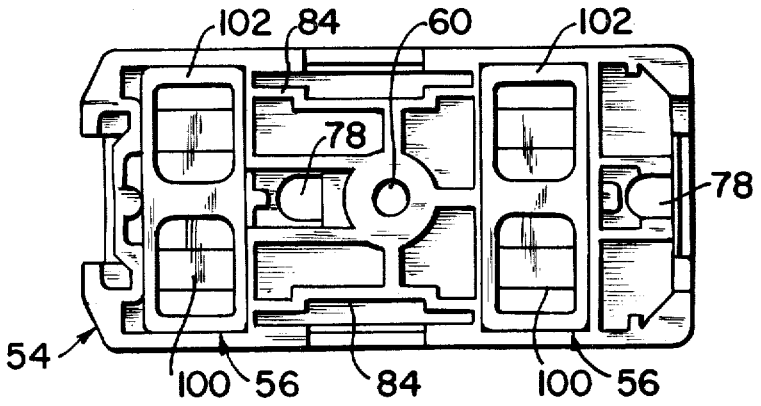
FIG. 3 is a plan view of the cover of the receptacle taken along the line 3—3 in FIG. 1, the view showing a safety shutter mechanism embodying the invention mounted beneath each pair of the receptacle slots.
Figure 4:
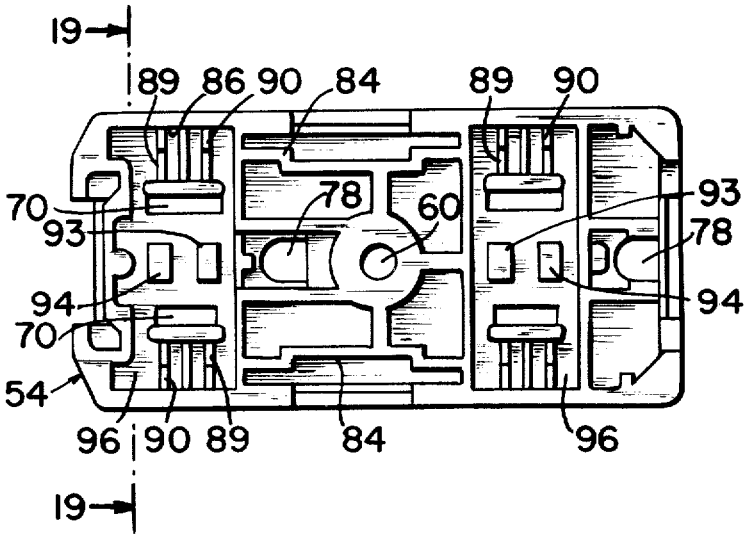
FIG. 4 is a plan view of the cover, similar to that of FIG. 3, with the shutters of the invention being deleted to show the interior portion of a housing which contains the shutters.

Upon emplacement of the shutter 56 within the cover 54, as seen in FIG. 19, the spring 112 sits between the inner post 93 and the outer post 94 of FIG. 4 which aide in securing the spring 112 in its location between the two cams 108A–B. The ribs 89 and 90 accommodate respectively the blades 106 and the frame 102 as seen in FIG. 19, the ribs 89 and the elongated portion of the ribs 90 being sufficiently large to accommodate the sliding movement of the blade 106. Also, as was noted with reference to FIG. 4, channels 96 are provided alongside of the ribs 89–90 to accommodate the ends of the spines 124A–B.

The operation of the shutter 56 may be seen with reference to FIGS. 18–19, wherein a prong 72 presses against the cam surface 134A of the cam 108A to deflect the cam 108A towards the posts 93–94 against the force of the spring 112. To facilitate the description of the operation, it is convenient to further identify the prongs 72 by the legends A and B such that the prong 72A presses against the cam surface 134A of the cam 108A while the prong 72B presses against the cam surface 134B of the cam 108B. Upon the inward deflection of the cam 108A, the blade 106A is slid outwardly and away from the center line of the prong 72B and its corresponding slot 70B. In an analogous fashion, the advancement of the prong 72B against the cam surface 134B deflects the cam 108B and its slide 100B with the blade 106B towards the right with the result that the slide 106B no longer blocks the passage of the prong 72A through the slot 70A. Thereby, as the prongs 72 advance through the slots 70, both the cams 108 and the blades 106 are displaced from the center lines of the corresponding slots 70 so as to permit passage of the prongs 72 completely past the slides 100 and through the frame 102 for mating with the terminals 68 in the base 52 of the receptacle 50 as seen in FIGS. 1–4. The spaces in the frame 102 between the side arms 116 and the struts 118 are large enough to accommodate the prongs 72 and are positioned relative to the prongs 72 so as to accommodate their passage.

In the event that only one of the prongs 72 were present, or in the event that a similarly shaped object such as a screw driver or other blade-type toy which may be manipulated by a child is applied to one of the slots 70, for example, the slot 70A, then it is apparent that the cam 108A and the blade 106A are deflected while the blade 106B remains in its position. Since the blade 106B is located directly in line with the slot 70A, the blade 106B serves as a barrier to the passage of a blade-type toy and thereby protects the child from the hazard of electrical shock which may be experienced in the event that the blade-type toy were to contact a terminal 68 in the base 52. Thereby, it is seen that upon application of a single blade to a slot 70, the shutter 56 prevents the entry of that blade into the base 52 but that, upon presentation of a pair of prongs 72 simultaneously to each of the slots 70, the shutter 56 opens passage to both of the slots 70 and permits the prongs 72 to engage the terminals 68 of the base 52.

ALTERNATIVE EMBODIMENT OF THE SHUTTER

FIGS. 20–35 portray an alternative embodiment of the invention wherein the slides of the shutter are deflected outwardly by the prongs of the plug, rather than being deflected inwardly as was described with reference to the FIGS. 1–19. To accomplish the outward deflection, the cam surfaces are oriented in the opposite sense, and each slide is provided with an integrally formed spring which extends outwardly from the slide to deflect the slide inwardly from a wall of the receptacle cover. In both the alternative and the previously described embodiment of the shutter, the shutter is formed with the same principal components, namely, a pair of slides which are urged in opposed directions across the slot of a receptacle cover by the prong of a plug. The slides in the two embodiments of the invention are configured with the same principal components, namely, a spine having a cam and a blade extending transversely thereof at opposite ends of the spine. In both embodiments of the invention, the blade and cam are disposed on opposite sides of a transverse plane of the slide to permit the interlocking positioning of one slide within the other slide of the pair of slides in a shutter. In the alternative embodiment, the cam surfaces are disposed along the inner aspects of the respective cams, the inner aspect being the side of the cam which faces the blade of the slide. This disposition of the cam surface is in contradistinction to the location of the cam surface on the outer aspect of the cam as disclosed in the previously described embodiment. The springs in the alternative embodiment are disposed, accordingly, along the outer aspect of the slides to urge the cam surfaces against the prongs of a plug.

The foregoing aspect of the alternative embodiment of the shutter will now be described in greater detail.

Referring now to FIG. 20, there is seen a shutter 200 nested within a housing 202 of a cover 204 of a receptacle. The shutter 200 includes a frame 206 positioned above a pair of slides 208. Blades 210 of the respective slides 208 face corresponding slots 212 (seen in FIG. 35) of the cover 204 for preventing the entry of a blade-shaped object into one of the slots 212. Thus, it is seen that the shutter 200 is located within the cover 204 in the same manner as was taught previously with reference to the shutter 56 and the cap 54 of FIG. 3, the two shutters 204 and 56 providing protection in an analogous manner against the entry of unwanted objects within the slots of their respective receptacle covers 204 and 54.

Referring now to FIGS. 21–24, the slides 208 and the frame 206 of a shutter 200 are more readily seen. Each slide 208 comprises a spine 214 with a cam 216 and the aforementioned blade 210 depending therefrom. Springs 218 depend outwardly from the cams 216 for contacting the inner surface of the housing 202 for pushing the cams 216 towards each other, and thereby urging the blades 210 in registration with the respective slots of the receptacle cover. The posts 93–94 and the ribs 89–90 shown in FIG. 19 of the first embodiment of the invention have been deleted in the alternative embodiment of the invention and have been replaced with a single block 220 (shown in FIGS. 24 and 35) which is of square shape in plan view and serves as a guide during movement of the slides 208.

Referring now to FIGS. 25–28, the frame 206 comprises a pair of rails 222 joined by arms 224 and a strut 226. The depth of the arms 224 is reduced from the height of the strut 226 to provide clearance for the end of a spring 218 shown in FIGS. 20–24. The width of the frame 206 is equal to that of the slides 208 so that the slides 208 may rest against the frame 206 and thereby be guided by the frame 206 during movements of the slides 208. The width of the strut 226 is smaller than the spacing between the slots 212 of FIG. 35 to permit passage of the prongs 228 of a plug 230 through the slots 212.

Referring now to FIGS. 29–33, the cam 216 and the blade 210 of a slide 208 are more readily seen. Also shown is the spine 214 which connects with the cam 216 and the blade 210, and the spring 218 depending from the cam 216. A cam surface 232 is disposed along the inner aspect of the cam 216 facing the blade 210. Wings 235–237 are disposed, respectively, on the end of the cam 216, the inboard end of the blade 210 and the outboard end of the blade 210 to facilitate the positioning of the slides 208 in their interlocking relationship depicted in FIG. 33. The leading edge of the blade 210 is provided with a step 240, the stepped region extending less than halfway from the spine 214 so as to permit the interlocking relationship of the two steps 240 of a pair of the slides 208 depicted in FIG. 33. Also, as may be best seen in FIG. 30, the blade 210 is disposed above a transverse plane of the spine 214 while the cam 216 is disposed below the transverse plane to permit the aforementioned interlocking relationship wherein the blade 210 of one slide sits above the cam 216 of the other slide as depicted in FIG. 33. To facilitate a viewing of the respective components of the two slides 208 in FIG. 33, the legends A and B have been appended to the numerical legends identifying the components in the same manner as was done previously in FIG. 17.

Referring now to FIGS. 34 and 35, there are shown the relative positions of the components within the shutter 200 and the relative displacements of the components to provide passage for the prongs 228 of a plug 230. In FIG. 34, the pair of interlocking slides 208A–B are shown in contact with a rail 222 of the frame 206, the rails 222 of a slide 208 having a smooth surface to facilitate the sliding of the slides 208A–B. In FIG. 35, wherein the shutter 200 is shown schematically and in phantom, the blade 210A is shown coupled by a dashed line (identified by the legend A) to the cam 216A. Similarly, the blade 210B is shown coupled by a dashed line (bearing the legend B) to the cam 216B. Thereby, as the cam 216B is deflected to the left upon the insertion of the prong 228B, the blade 210B is also deflected to the left to clear a passage for the prong 228A. Similarly, upon a deflection to the right of the cam 216A upon insertion of the prong 228A, the blade 210A is also deflected to the right to clear a passage for the prong 228B. In the event that only a single blade shaped object is entered into a slot 212, such as by way of example, the prong 228B, the blade 210A remains stationary and blocks the passage of the prong 228B or such other objects which may be shaped similarly to the prong 228B, with the result that the cover 204 is secured against the inadvertent entry of a prong-shaped object into a slot 212. Thus, it is seen that the operation of the shutter 200 in the cover 204, as depicted in FIG. 35, follows that of the shutter 56 in the cover 54 as depicted in FIG. 19.

It is to be understood that the above-described embodiments of the invention are illustrative only and that modifications thereof may occur to those skilled in the art. Accordingly, this invention is not to be regarded as limited to the embodiments disclosed herein, but is to be limited only as defined by the appended claims.

What is claimed is:

1. A shutter for selectively opening the slots of an electrical receptacle, said shutter comprising:

a frame and a pair of slides in contact therewith for sliding thereon;

each of said slides being formed of a longitudinal member having two transverse members coupled thereto, said transverse members being offset from each other in both longitudinal and transverse directions relative to said longitudinal member;

one of said slides being located about said frame in opposed relationship to the other of said slides wherein said longitudinal member of one of said slides is spaced apart from the longitudinal member of the other of said slides; and wherein a first of said transverse members of each of said slides serves as a barrier for closing the passageway of one of said slots, a second of said transverse members of each of said slides serves as a cam for deflecting said barrier when an implement is inserted through another of said slots.

2. A shutter according to claim 1 further comprising resilient spacer means for spacing said first transverse member in each of said slides with a spacing corresponding to the spacing between said slots of said receptacle.

3. A shutter according to claim 2 wherein a cam surface is disposed along an outer aspect of said cam.

4. A shutter according to claim 2 wherein a cam surface is disposed along an inner aspect of said cam.

5. A shutter according to claim 4 further comprising spring means for urging said cams toward each other.

6. An electrical receptacle having shuttered slots comprising:

a cover containing slots along a face of said cover for entry of prongs of an electrical plug;

a housing within said cover behind said slots;

a shutter contained within said housing, said shutter including a stationary member and two sliding members, said housing having guide structures for guiding the movement of said movable members;

each of said movable members having a longitudinal spine, and a barrier for closing the passageway of one of said slots and a cam, partially blocking the passageway of another of said slots, for moving said barrier, said barrier and cam protruding transversely from said spine, said spine being oriented parallel to an axis passing from one of said slots to a second of said slots; and wherein said barrier and said cam are displaced from each other in both longitudinal and transverse directions about said spine to permit an interleaving of the barrier and cam of one of said movable members with, respectively, the cam and barrier of the other of said movable members.

7. A receptacle according to claim 6 wherein the barrier of one of said movable members is contiguous to the cam of the other of said movable members, the corresponding contiguous surfaces of said barrier and said cam being configured to permit a sliding of said barrier of said first of said movable members past said cam of said second of said movable members.

8. A receptacle according to claim 7 wherein a cam surface of said cam faces one of said slots for engagement with a prong of said electrical plug.

9. A receptacle according to claim 8 wherein said cam surface is disposed along an outer aspect of said cam.

10. A receptacle according to claim 8 wherein said cam surface is disposed along an inner aspect of said cam.

11. A receptacle according to claim 10 further comprising spring means for urging the cam of one of said movable members towards the cam of the other of said movable members.

12. A shutter for the slots of an electrical receptacle comprising:

a pair of identical slides each of which comprises a spine and two legs extending transversely thereof, the two legs in each of said slides having a spacing equal to the spacing between two slots of said receptacle so that one of said two legs in each of said slides serves as a barrier for closing the passageway of one of said two slots and the other of said two legs in each of said slides serves to partially block the passageway of the other of said two slots, the two legs in each of said slides being displaced in opposite directions about a plane parallel to a longitudinal axis of the spine of the slide, the spine of one of said slides being configured to accommodate a sliding movement of the ends of the legs of the other of said slides; and means responsive to the force of an electrical plug which mates with said receptacle for displacing said slides about said slots.

13. A shutter according to claim 12 further comprising means coupled to said slides for restoring their positions relative to said slots upon removal of said force of said electrical plug.

14. A shutter according to claim 12 wherein said displacing means includes a cam surface on a leg of each of said slides for deflecting said leg in response to an urging by a prong of said plug.

15. A shutter for an electrical receptacle comprising:

a pair of blades and a pair of cams, said blades being spaced apart by a distance equal to the spacing between a corresponding pair of entry points in said receptacle through which electric contacts enter said receptacle;

means for sliding said blades in a common plane behind said entry points, said cams being positioned between said blades and said entry points;

first means for coupling a first of said cams which is adjacent a first of said entry points to a second of said blades which is adjacent and blocking a second of said entry points, said first coupling means being configured to permit a slidable nesting of a second of said cams which is adjacent said second of said entry points and the first of said blades therein which is adjacent and blocking said first of said entry points; and second means for coupling the second of said cams to the first of said blades.

16. A shutter according to claim 15 further comprising spring means connecting with said cams for urging said cams against said electric contacts, upon entry of said electric contacts.

17. A shutter according to claim 15 further comprising spring means integrally formed with said cams for urging said cams toward each other.

18. A shutter for selectively opening the slots of an electrical receptacle, said shutter comprising:

a frame and a pair of slides in contact therewith for sliding thereon;

each of said slides being formed of a longitudinal member having two transverse members coupled thereto, said transverse members being offset from each other in both longitudinal and transverse directions relative to said longitudinal member;

one of said slides being located about said frame in opposed relationship to the other of said slides wherein said longitudinal member of one of said slides is spaced apart from the longitudinal member of the other of said slides;

a first of said transverse members in each of said slides serves as a barrier for closing the passageway of one of said slots, said second transverse member in each of said slides serving as a cam for deflecting said barrier;

resilient spacer means for spacing said first transverse member in each of said slides with a spacing corresponding to the spacing between said slots of said receptacle;

a cam surface disposed along an inner aspect of said cam; and spring means for urging said cams toward each other, said spring means comprising a spring member formed integrally with one of said slides.

19. A shutter for selectively opening the slots of an electrical receptacle, said shutter comprising:

a frame and a pair of slides in contact therewith for sliding thereon;

each of said slides being formed of a longitudinal member having two transverse members coupled thereto, said transverse members being offset from each other in both longitudinal and transverse directions relative to said longitudinal member;

one of said slides being located about said frame in opposed relationship to the other of said slides wherein said longitudinal member of one of said slides is spaced apart from the longitudinal member of the other of said slides;

a first of said transverse members in each of said slides serves as a barrier for closing the passageway of one of said slots, said second transverse member in each of said slides serving as a cam for deflecting said barrier;

a cam surface disposed along an outer aspect of said cam; and spring means for urging said cams away from each other.

20. An electrical receptacle having shuttered slots comprising:

a cover containing slots along the face of said cover for entry of prongs of an electrical plug;

a housing within said cover behind said slots;

a shutter contained within said housing, said shutter including a stationary member and two sliding members, said housing having guide structures for guiding the movement of said moveable members;

each of said moveable members having a longitudinal spine, and a barrier and a cam protruding transversely from said spine, said spine being oriented parallel to an axis passing from one of said slots to a second of said slots;

said barrier and said cam being displaced from each other in both longitudinal and transverse directions about said spine to permit an interleaving of the barrier and cam of one of said moveable members with, respectively, the cam and barrier of the other of said moveable members;

the barrier of one of said moveable members being contiguous to the cam of the other of said moveable members, the corresponding contiguous surfaces of said barrier and said cam being configured to permit a sliding of said barrier of said first of said moveable members past said cam of said second of said moveable members;

a cam surface of said cam facing one of said slots for engagement with a prong of said electrical plug; and spring means for urging the cam of one of said moveable members away from the cam of the other of said moveable members, said stationary member having a guide which abuts leading edges of the barriers of respective ones of said moveable members in the absence of a deflecting force upon one of said cams.

21. A receptacle according to claim 20 wherein said cam of one of said movable members is positioned between one of said slots and said blade of the other of said movable members in the absence of a deflecting force upon one of said cams, said cam of said first movable member and said blade of said second movable member being displaced in opposite directions about the passageway of said slot upon the presence of deflecting forces on both of said cams.

22. A shutter for the slots of an electrical receptacle comprising:

a pair of identical slides each of which comprises a spine and two legs extending transversely thereof, the two legs in each of said slides having a spacing equal to the spacing between two slots of said receptacle, the two legs in each of said slots being displaced in opposite directions about a plane parallel to a longitudinal axis of the spine of the slide, the spine of one of said slides being configured to accommodate a sliding movement of the ends of the legs of the other of said slides;

means responsive to the force of an electrical plug which mates with said receptacle for displacing said slides about said slots; and means coupled to said slides for restoring their positions relative to said slosts upon removal of said force of said electrical plug, said restoring means comprising springs integrally formed with each of said slides.

23. A shutter for an electrical receptacle comprising:

a pair of blades and a pair of cams, said blades being spaced apart by a distance equal to the spacing between a corresponding pair of entry points in said receptacle to which electric contacts enter said receptacle;

means for sliding said blades in a common plane behind said entry points, said cams being positioned between said blades and said entry points;

first means for coupling a first of said cams which is adjacent a first of said entry points to a second of said blades which is adjacent a second of said entry points, said first coupling means being configured to permit a slidable nesting of the second of said cams and the first of said blades therein;

second means for coupling the second of said cams to the first of said blades;

spring means connecting with said cams for urging said cams against said electric contacts, upon entry of said electric contacts; and a guide interposed between said blades, said blades being urged toward said guide in response to the force of said spring.

* * * * *